US006962505B1

(12) United States Patent
Savicki, Jr. et al.

(10) Patent No.: US 6,962,505 B1
(45) Date of Patent: Nov. 8, 2005

(54) ELECTRICAL SWITCH WITH PLACARD AND REMOTE USE INDICATOR

(75) Inventors: Gerald R. Savicki, Jr., Syracuse, NY (US); Dejan Radosavljevic, LaFayette, NY (US)

(73) Assignee: Pass & Seymar/Legrand, Syracuse, NY (US)

( * ) Notice: Subject to any disclaimer, the term of this patent is extended or adjusted under 35 U.S.C. 154(b) by 0 days.

(21) Appl. No.: 10/726,137

(22) Filed: Dec. 2, 2003

Related U.S. Application Data

(60) Provisional application No. 60/439,370, filed on Jan. 9, 2003.

(51) Int. Cl.[7] ..... H01R 3/00
(52) U.S. Cl. ..... 439/491; 200/317; 368/10
(58) Field of Search ..... 439/490–491; 200/317; 368/10

(56) References Cited

U.S. PATENT DOCUMENTS 4,282,591 A * 8/1981 Andreuccetti ..... 368/10
4,667,073 A * 5/1987 Osika ..... 200/317
4,794,356 A * 12/1988 Yu et al. ..... 335/13
4,947,054 A * 8/1990 Flowers et al. ..... 307/125
6,696,932 B2 * 2/2004 Skibinski et al. ..... 340/438
6,752,649 B2 * 6/2004 Arkin et al. ..... 439/491

* cited by examiner

*Primary Examiner*—Truc Nguyen
(74) *Attorney, Agent, or Firm*—Daniel P. Malley; Bond, Schoeneck & King

(57) ABSTRACT

An electrical device for use in an electric circuit. The electrical device includes a housing and at least one wiring device disposed within the housing. The at least one wiring device includes an electrical switch. The electrical switch includes at least one terminal member configured to be coupled to the electric circuit. The electrical switch is configured to selectively energize at least one load. The electrical device further includes a remote use indictor module disposed within the housing. The remote use indicator includes a remote use indicator circuit coupled to the electrical switch and a remote use indicator coupled to the remote use indicator circuit. The remote use indicator circuit is configured to detect when the at least one load is energized or de-energized, and actuate the remote use indicator in response thereto. The electrical device further includes an indicia holder disposed in the housing. The indicia holder is configured to display an indicia identifying a remote location of the at least one load and/or an ornamental image.

29 Claims, 1 Drawing Sheet

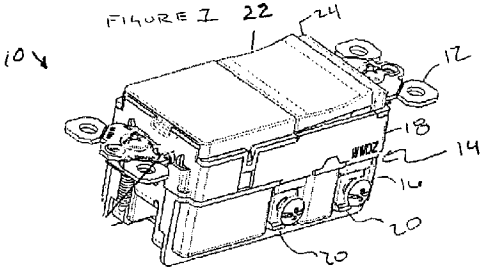
FIGURE 1
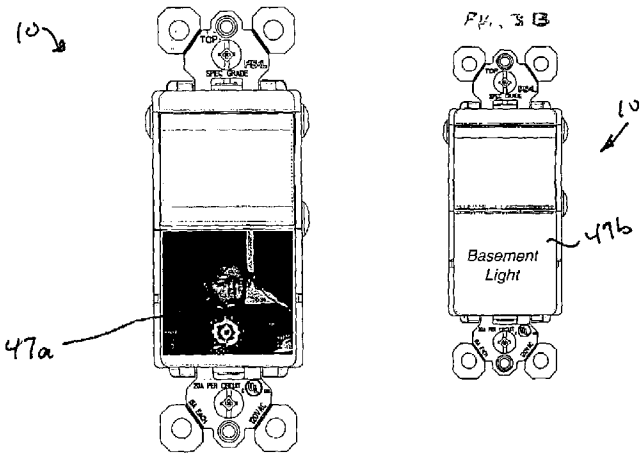
FIG. 3B
FIG 3A
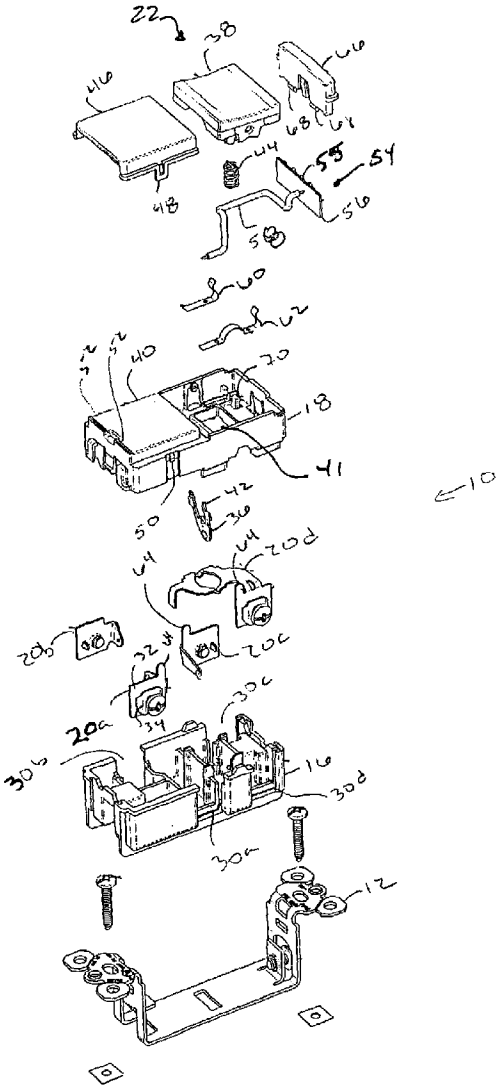
FIGURE 2

ELECTRICAL SWITCH WITH PLACARD AND REMOTE USE INDICATOR

CROSS REFERENCE TO RELATED APPLICATIONS

This application claims the benefit of priority under 35 U.S.C. § 119(e) of Provisional U.S. patent application Ser. No. 60/439,370 filed on 9 Jan. 2003, the content of which is relied upon and incorporated herein by reference in its entirety.

BACKGROUND OF THE INVENTION

1. Field of the Invention

The present invention relates to an electrical wiring device and more particularly to an electrical wiring device suitable for commercial and residential use.

2. Background of the Invention

Conventional wall mounted electrical switches do not typically provide a visual indication that the switch is providing power to a remote location. Further, conventional wall mounted electrical switches do not typically provide a place for a placard used in identifying the circuit controlled by the switch. As such, a person encountering the switch for the first time must use trial and error to discover the switch that applies power to the desired area or device. A person randomly turning switches on and off can inadvertently and inconveniently cut off power from a device or group of devices. In addition, because wall mounted conventional electrical switches do not provide such a visual indication, lighting fixtures and other fixtures may be left on. As a result, electrical energy may be wasted and utility bills may be higher.

Thus there is a need for an electrical wiring device that indicates use in a remote location and provides a mounting space for a visual placard identifying that remote location.

SUMMARY OF THE INVENTION

The present invention addresses the needs described above. The present invention provides an electrical wiring device that indicates use in a remote location and provides a mounting space for a visual placard identifying that remote location.

In one embodiment, the present invention includes an electrical device for use in an electric circuit. The electrical device includes a housing and at least one wiring device disposed within the housing. The at least one wiring device includes an electrical switch. The electrical switch includes at least one terminal member configured to be coupled to the electric circuit. The electrical switch is configured to selectively energize at least one load. The electrical device further includes a remote use indictor module disposed within the housing. The remote use indicator includes a remote use indicator circuit coupled to the electrical switch and a remote use indicator coupled to the remote use indicator circuit. The remote use indicator circuit is configured to detect when the at least one load is energized or de-energized and actuate the remote use indicator in response thereto. The electrical device further includes an indicia holder disposed in the housing. The indicia holder is configured to display an indicia identifying a remote location of the at least one load and/or an ornamental image.

In yet another embodiment, the present invention includes an electrical device for use in an electric circuit. The device includes a housing having a planar surface of at least 0.8 square inches in area. At least one wiring device is disposed within the housing. The at least one wiring device includes an electrical switch. The electrical switch includes at least one terminal member configured to be coupled to the electric circuit. The electrical switch is configured to selectively energize at least one remote load. An indicia holder is disposed on the planar surface of the housing, and configured to display an indicia identifying the remote load selectively energized by the at least one wiring device disposed within the housing.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

BRIEF DESCRIPTION OF THE DRAWINGS

FIG. 1 is a perspective view of an one embodiment of the electrical device of the present invention;

FIG. 2 is an exploded view of the electrical device shown in FIG. 1;

FIGS. 3*a* and 3*b* are front views of embodiments of the present invention.

DETAILED DESCRIPTION

Reference will now be made in detail to the present embodiments of the invention, examples of which are illustrated in the accompanying drawings. Whenever possible, the same reference numerals will be used throughout the drawings to refer to the same or like parts.

One embodiment of the electrical device of the present invention is shown in FIG. 1 and is designated generally throughout by the reference numeral 10. The electrical device 10 includes ground strap 12, a housing 14, a switch 22 disposed with the housing 14 and a remote use indicator light module 24.

A better understanding of the embodiment of the present invention illustrated in FIG. 1 may be gained by considering FIG. 2 which is an exploded view of the electrical device 10 shown in FIG. 1. The electrical device 10 shown in FIG. 2 includes an electrical switch 22, such as, for example the three way switch, a single pole switch or a dual single pole switch unit; FIG. 2 shows a three way switch.

The electrical device 10 includes a ground strap 12. The ground strap 12 is made from an electrically conductive metal and is configured for mounting the electrical device 10 into a conventional wall box (not shown). The strap 12 is further configured to receive the housing 14. The housing 14 includes a body 16 and a frame 18 that work in cooperation to provide mounting places for the components of the electrical device 10, such as, for example terminals and electrical switch components. The body 16 and frame 18 will be described with specific reference to FIG. 2 in order to illustrate one embodiment of the invention.

It will be readily apparent to those of ordinary skill in the art that, in view of the teachings disclosed herein, modifications to the described embodiment may be made to incorporate a variety of electrical wiring devices without departing from the scope of the present disclosure. Both the body 16 and frame 18 are made from a non-electrically conductive material, such as, for example plastic and may be made for example, by molding process, such as, for example and injection molding process.

The body 16 is configured to receive a plurality of terminals 20*a*, 20*b*, 20*c*, 20*d*. The terminals 20*a*, 20*b*, 20*c*, 20*d* fit into openings 30*a*, 30*b*, 30*c*, 30*d* in the sides of the body 16. The periphery of each of the openings 30*a*, 30*b*, 30*c*, 30*d* is configured to securely hold the terminals 20*a*, 20*b*, 20*c*, 20*d* in predetermined positions that electrically isolate the terminals 20*a*, 20*b*, 20*c*, 20*d* from one another. The terminals 20*a*, 20*b*, 20*c*, 20*d* include two stationary terminals 20*a*, 20*c* and a pivot terminal 20*d*. Each of the terminals 20*a*, 20*c*, 20*d* is configured for the coupling of an electrically conductive wire thereto. In the embodiment shown in FIG. 2 each of the terminals includes a contact surface 32 and a clamping plate 34.

The pivot terminal 20*d* is configured to receive a moveable three way contact 36. In operation of the three way switch, the moveable three way contact 36 is selectively positioned between the first stationary terminal 20*a* and the second stationary terminal 20*c*.

The electrical device 10 further includes a frame 18. The frame 18 is configured to engage the body 16 thereby further securing the terminals 20*a*, 20*b*, 20*c*, 20*d* in place. The frame 18 is configured to receive a switch paddle 38 and also includes a planar surface 40. Planar surface 40 is at least 0.8 square inches in area.

The frame 18 further includes an opening 41 positioned to allow the switch paddle 38 to engage the moveable three way contact 36, thereby allowing the switch to function.

The switch paddle 38 is configured to receive the end 42 of the moveable three way 36. In the embodiment shown in FIG. 2 the underside of the switch paddle 38 includes slots for receiving the two sides of the end 42. The slots are sized such that when the end 42 of the moveable three way contact 36 is pressed into the slots the moveable three way contact 36 is securely coupled to the switch paddle 38. A coil spring 44 is captured between switch paddle 38 and the moveable three way 36 and provides the biasing force which maintains the switch paddle in the position selected by the user.

The electrical device 10 further includes a lens 46. The lens 46 is see-through member, such as, for example a cleat plastic member, that fits over the planar surface 40 and couples to the frame 18. The lens 46 includes resilient members 48 that engage protrusions 50 extending from the sides of the frame 18. The lens 46 so coupled to the frame 18 defines a cavity in which a placard bearing images or text may be inserted. In the embodiment shown, one edge of planar surface 40 includes retention members 52 extending from the planar surface 40. The retention members 52 help to keep the placard within the cavity defined by the lens 46 and the planar surface 40. Device 10 can be sold with a removable instruction sheet disposed between planar surface 40 and lens 46 that describes the purpose of the placard holder and/or provides indicia examples.

In an alternate embodiment, a surface of lens 46 can include raised bumps or symbols to provide tactile indicia. The tactile indicia can be configured to permit a placard with text or image indicia disposed between the planar surface 40 and lens 46 to be readable, if provided.

The remote use indicator light module 24 further includes a lens blank 66 which is disposed over a remote use indicator light module 54. The light module 54 includes a light source 55 such as one or more light emitting diodes mounted to a substrate. The substrate may be a printed circuit board 56 used to accommodate a remote use indicator circuit. The light module 54 is configured to provide illumination when the electrical device 10 is supplying power to a load, at location remote from the electrical device 10, such as a light in a basement, garage or separate room. In an alternate embodiment, light module 54 is configured to provide illumination when the electrical device 10 is not supplying power to a load, at the location remote from the electrical device 10.

The light source 55 is electrically coupled to printed circuit board 56. In another embodiment, remote indicator module 24 may be a snap- in part. In this embodiment, lens 66 and module 55 are an integral part equipped with contacts. A matching set of contacts is disposed in frame 18. These contacts are coupled to switch 38.

The electrical device 10 further includes a first light clip 60 and a second light clip 62. The first and second light clips 60, 62 are spaced apart from one another and are coupled to the frame 18. The first light clip 60 engages a contact member 64 extending from the first stationary terminal 20*c*. The second light clip 62 engages a contact member 64 extending from the second stationary terminal 20*a* and a contact member extending from the pivot terminal 20*d*. An end of each of the first and second light clips 60, 62 respectively engage electrical contacts on the printed circuit board 56. These contacts are part of the electrical circuitry mounted on the printed circuit board 56 that controls the operation of the light source 55. When switch paddle 38 is actuated, three way contact 36 is actuated in response. Clips 62 and 60 transmit the current to the remote use circuit which, in turn, actuates light source55.

Referring to FIG. 3*a*, a placard 47*a* including a symbol or photograph is disposed between placard holder 46 and planar surface 40. The symbol may designate the purpose of the switch, identify the occupant of a living space, provide ornamental design, or the like. The ornamental design may serve to visually associate switches that are remotely located from one another, for example, the ornamental design may visually associate two three way switches that are remote from one another, the two switches configured to operate the same load.

Referring to FIG. 3*b*, a placard 47*b* including human readable indicia is disposed between placard holder 46 and planar surface 40. The human readable indicia may identify the remote load controlled by switch 22, and may be of a color or combined with a symbol to designate that the switch should be used with a degree of caution, for example, a switch configured to operate a garbage disposal or a lift. Electrical device 10 may further include a light module 54. If a light module 54 is provided, the human readable indicia may provide interpretation of the presence or absence of emitted light from light source 55.

In another embodiment, electrical device 10 further includes a timer. Reference is made to U.S. Pat. No. 4,591,781, which is incorporated herein by reference as though fully set forth in its entirety, for a more detailed explanation of the timer. Switch 22 is configured as a three way switch to control a load. The switch is provided with a first position in which the load is off, a second position in which the load is energized, and a third position in which the load is energized and de-energized in a repeating pattern established by the timer. The third position can be used, for example, as a beaconing means. For example, the load can be a porch light that flashes when switch 22 is in the third position. The homeowner can toggle switch 22 to the third position for signaling the location of the residence to an emergency vehicle and/or to a delivery vehicle. The third position may have any number of uses. Provision of a lens 46 and placard 47 included in electrical device 10 permits an indicia for defining the intended use of the third position of the switch. Alternatively, switch 22 can be configured to have two positions, in which the load is off in the first position and energized and de-energized in a repeating pattern in the second position.

Those of ordinary skill in the art will appreciate that modifications may be made to remote use indicator 24. For example, indicator 24 may be configured to emit a red light when the remote load is not in use, and emit a green light when the load is energized. Further, a light indicating a proper wiring condition may also be incorporated in indicator 24.

The electrical device 10 further includes a removably engageable lens blank 66. The lens blank 66 may be made from a transparent or translucent material. Furthermore, the lens blank may incorporate, for example, a refractive or a diffractive lens or a combination of lens so as to provide a desired illumination pattern. The lens blank 66 includes a plurality of resilient members 68 that are configured to engage complimentary resilient fingers 70 disposed in the frame 18. This configuration allows the lens blank 66 to be "snapped" in place and securely coupled to the frame 18.

In an alternative embodiment, the three way switch of the electrical device 10 is replaced with a single pole switch or a dual single pole switch unit.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

What is claimed is:

1. An electrical device for use in an electric circuit, the device comprising:

a housing;

at least one wiring device disposed within the housing, the at least one wiring device including an electrical switch, the electrical switch including at least one terminal member configured to be coupled to the electric circuit, the electrical switch being configured to selectively energize at least one load;

a remote use indicator module disposed within the housing, the remote use indicator including a remote use indicator circuit coupled to the electrical switch and a remote use indicator coupled to the remote use indicator circuit, the remote use indicator circuit being configured to detect when the at least one load is energized and/or de-energized, and actuate the remote use indicator in response thereto; and an indicia holder disposed in the housing, the indicia holder being configured to display a removable indicia identifying a remove location of the at least one load and/or an ornamental image, the indicia being tactile or visual in nature.

2. The device of claim 1 wherein the indicia holder includes:

a planar surface integral to the housing;

a placard having the indicia disposed thereon; and a lens plate disposed over the placard and the planar surface, the placard being disposed between the planar surface and the lens plate.

3. The device of claim 1, wherein the remove use indicator circuit is disposed on a circuit board.

4. The device of claim 3, wherein the circuit board is hard wired to the electrical switch.

5. The device of claim 3, wherein the housing includes a receptacle formed therein, the receptacle including at least one receptacle contact element that is electrically coupled to the electrical switch.

6. The device of claim 5, wherein the remote use indictor module includes at least one module contact element and has a form factor that is configured to be inserted into the receptacle such that the at least one module contact element engages the at least one receptacle contact element such that electrical connectivity is established between the remove use indictor module and the electric switch.

7. The device of claim 6, the pilot light module also being removable from the pilot light receptacle to thereby disengage the at least one pilot circuit contact member from the contact element.

8. The device of claim 1, wherein the remote use indicator includes at least one light emitting diode.

9. The device of claim 1, wherein the remove use indicator includes at least one neon lamp.

10. The device of claim 1, wherein the indicia holder includes an image bearing media for displaying the indicia.

11. The device of claim 10, wherein the image bearing media is removable from the indicia holder.

12. The device of claim 10, wherein the indicia includes text.

13. The device of claim 10, wherein the indicia includes both text and at least one image.

14. The device of claim 1, wherein the remote use indicator emits a light in response to being actuated by the remote use circuit.

15. The device of claim 1, wherein the remote use indicator emits a color coded light signal.

16. The device of claim 15, wherein the remote use indicator emits a first color when not actuated by the remote use indicator circuit, and emits a second color when actuated by the remote use indicator circuit.

17. The device of claim 15, wherein the remote use indicator emits a third color when the electrical device is wired correctly.

18. An electrical device for use in an electric circuit, the device comprising:

a housing having a planar surface of at least 0.8 square inches in area;

at least one wiring device disposed within the housing, the at least one wiring device including an electrical switch, the electrical switch including at least one terminal member configured to be coupled to the electric circuit, the electrical switch being configured to selectively energize at least one remote load, an indicia holder disposed on the planar surface of the housing, configured to display an indicia identifying the remote load selectively energized by the at least one wiring device disposed within the housing.

19. The device of claim 18 wherein the indicia holder is configured to provide tactile indicia identifying the load selectively energized by the at least one wiring device disposed within the housing.

20. The device of claim 19 wherein the indicia holder is configured to combine tactile indicia and human readable indicia.

21. The device of claim 20 wherein the human readable indicia includes a symbol.

22. The device of claim 20 wherein the human readable indicia includes a configuration of alpha-numeric characters.

23. The device of claim 18 wherein the indicia holder is configured to provide human readable indicia identifying the remote load selectively energized by the at least one wiring device disposed within the housing.

24. The device of claim 23 wherein the human readable indicia includes a symbol.

25. The device of claim 23 wherein the human readable indicia includes a configuration of alpha-numeric characters.

26. The device of claim 23 wherein the human readable indicia includes a photograph.

27. The device of claim 18, wherein the housing includes a receptacle formed therein, the receptacle including at least one receptacle contact element that is electrically coupled to the electrical switch.

28. The device of claim 18, further including a timer, wherein the electric switch is configured to selectively energize the at least one remote load in a repeating energizing pattern, the repeating energizing pattern being predetermined by the timer, the indicia holder being configured to provide indicia corresponding to the repeating energizing pattern.

29. The device of claim 18, wherein the indicia holder includes:

a placard having the indicia disposed thereon; and a lens plate disposed over the placard and the planar surface, the placard being disposed between the planar surface and the lens plate.

* * * * *

UNITED STATES PATENT AND TRADEMARK OFFICE

CERTIFICATE OF CORRECTION

PATENT NO. : 6,962,505 B1 
DATED : November 8, 2005
INVENTOR(S) : Gerald R. Savicki, Jr. et al.

It is certified that error appears in the above-identified patent and that said Letters Patent is hereby corrected as shown below:

Title page,
Item [73], Assignee, should read -- Pass & Seymour/Legrand, Syracuse, NY (US) --.

Signed and Sealed this

Thirty-first Day of January, 2006

JON W. DUDAS
*Director of the United States Patent and Trademark Office*